US006683399B2

(12) United States Patent
Shiffler, Jr.

(10) Patent No.: US 6,683,399 B2
(45) Date of Patent: Jan. 27, 2004

(54) FIELD EMISSION COLD CATHODE

(75) Inventor: Donald A. Shiffler, Jr., Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 48 days.

(21) Appl. No.: 09/681,703

(22) Filed: May 23, 2001

(65) Prior Publication Data

US 2002/0175609 A1 Nov. 28, 2002

(51) Int. Cl.[7] ..... H01J 19/06

(52) U.S. Cl. ..... 313/311; 313/346 R; 313/309; 313/310

(58) Field of Search ..... 313/309, 310, 313/311, 326, 346 R, 351; 445/50, 51

(56) References Cited

U.S. PATENT DOCUMENTS 4,143,292 A * 3/1979 Hosoki et al. ..... 313/336
6,091,186 A 7/2000 Cao et al.
6,239,547 B1 * 5/2001 Uemura et al. ..... 313/495
6,400,091 B1 * 6/2002 Deguchi et al. ..... 315/169.1

OTHER PUBLICATIONS

Benford, J. et al., "Lowered plasma velocity with cesium iodide/carbon fiber cathodes at high electric fields," Proceedings of the 12th International Conference on High–Power Particle Beams, vol. 2, 1998, pp. 695–698.*

Garate E. et al., "Novel cathode for field–emission applications," Review of Scientific Instruments, vol. 66, No. 3 (Mar. 1995), pp. 2528–2532, American Institute of Physics, New York, New York, USA.

Kosai H. et al., "Long pulse Csl impregnated field emission cathodes," Review of Scientific Instruments, vol. 61, No. 7 (Jul. 1990), pp. 1880–1882, American Institute of Physics, New York, New York, USA.

Wadhawan A. et al., "Effects of Cs deposition on the field–mission properties of single–walled carbon–nanotube bundles," Applied Physics Letters, vol. 78, No. 1 (Jan. 1, 2001), pp. 108–110, American Institute of Physics, New York, New York, USA.

Chang I. F. et al., "Large–area, Cold, Electron–emitters for Electron Emission," IBM® Technical Disclosure Bulletin, vol. 18, No. 9 (Feb. 1976), pp. 3097–3098.

* cited by examiner

*Primary Examiner*—Ashok Patel
*Assistant Examiner*—Jason Phinney
(74) *Attorney, Agent, or Firm*—James M. Skorich; Kenneth E. Callahan

(57) ABSTRACT

A field emission cold cathode for use in vacuum tubes. A carbon velvet material is coated with a low work function cesiated salt and bonded to a cathode surface. The cathode will emit electrons when an electric field is applied. The carbon velvet material is comprised of high aspect ratio carbon fibers embedded perpendicular to a base material.

6 Claims, 1 Drawing Sheet

FIELD EMISSION COLD CATHODE

FEDERAL RESEARCH STATEMENT

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF INVENTION

The invention is in the field of vacuum tubes, and more particularly relates to a field emission cold cathode acting as an electron emitter in a vacuum tube.

Cathodes are electron emitters used in a wide variety of vacuum tubes, such as cathode ray tubes used in televisions and various microwave tubes used in radar and communications. All of these cathodes must be kept under a high vacuum and heated to a very high temperature (>900° C.) for proper operation.

High vacuum necessitates the use of special manufacturing techniques, such as having a device that is sealed, as well as extensive baking out procedures. Further, these types of cathodes are susceptible to contamination if the cathode is ever removed from vacuum. The high vacuum thus provides a considerable constraint to tube handling, operation, and storage.

The requirement for high temperature operation poses two severe restrictions. The high temperature requires the use of special materials that can withstand the high temperature operation of the cathode. In addition, the heater reduces the energy efficiency and increases system volume, weight, and complexity.

Accordingly, there is a need for a cathode that can operate at low temperatures and have less stringent vacuum requirements, while delivering the same electron emission characteristics as conventional vacuum tube cathodes.

SUMMARY OF INVENTION

In a preferred embodiment, the invention replaces the heated cathode of a conventional vacuum tube with a field emission cold cathode. The cathode is comprised of a carbon velvet material coated with a low work function cesiated salt and bonded to a cathode surface. Electrons are emitted when a sufficient voltage is applied to the cathode. It is considerably more energy efficient than a conventional vacuum tube and can operate at a lower vacuum level. The carbon velvet material is a material comprised of high aspect ratio carbon fibers embedded perpendicular to a base material. The carbon velvet material anticipated by the present invention can be bonded to any complex-shaped cathode. This cold cathode can replace the heated cathode of any type of vacuum tube, including, klystrons, traveling wave tubes, magnetrons, magnicons, and klystrode/IOT TV transmitters.

Other aspects and advantages of the present invention will become apparent from the following detailed description, taken in conjunction with the accompanying drawing, illustrating by way of example the principles of the invention.

DETAILED DESCRIPTION

Figure 1:
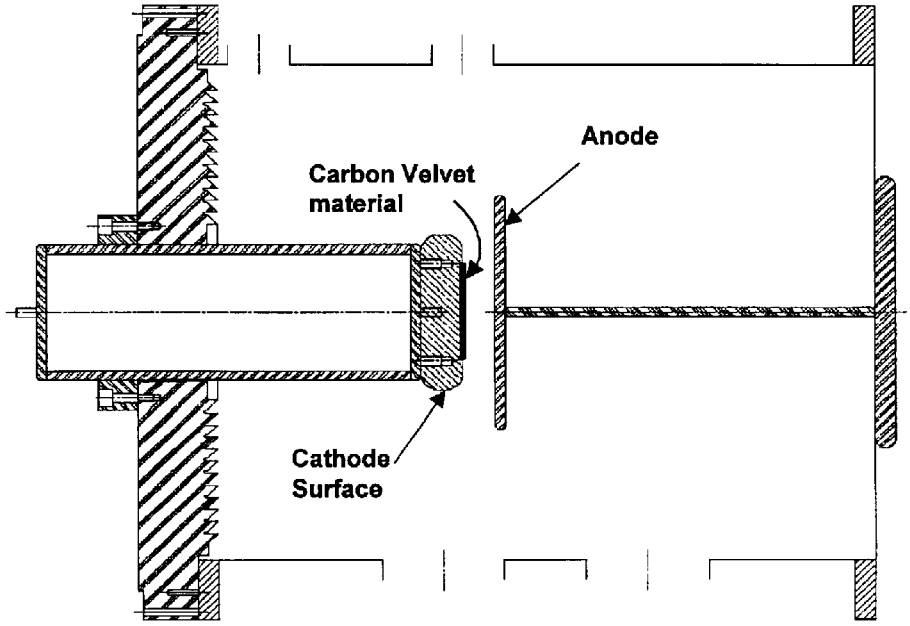
FIG. 1 is a schematic of the laboratory setup, including a cross-section of the present invention, used to test the field emission cold cathode characteristics.

Conventional vacuum tubes require a high vacuum and a cathode element that must be heated to over 900° C. for proper operation. The field emission cold cathode of the present invention eliminates the heating requirement and operates at a lower vacuum level. The term, cold cathode, refers to a cathode that operates at or near room temperature, but also refers to cathodes that operate at temperatures below 900° C.

A preferred embodiment of the field emission cold cathode is comprised of a carbon velvet material that is treated with a low work function cesiated salt and bonded to a cathode surface. The carbon velvet material consists of high aspect ratio carbon fibers embedded perpendicular to a base material. A particular material of this type is VEL-BLACK® optical coating, a proprietary product of Energy Science Laboratories, Inc. It consists of high aspect ratio carbon fibers mounted in an adhesive base. It was developed for its optical characteristics, i.e., as a black applique for ultra-low reflectance and used for stray-light suppression in optical systems.

The material is flexible and can be readily bonded to any shape of cathode. A conductive epoxy can be used to bond the carbon velvet material to a metal cathode or pyrobonding can be used to bond the material to a carbon substrate.

The low work function cesiated salt can be deposited on the carbon velvet material in several different methods. Two of the preferred methods of making the present invention employ a solution of highly purified cesiated salt and de-ionized (DI) water as the medium for cesiated salt deposition. Cesiated salt is first mixed with deionized water. The carbon velvet material can then be sprayed with the cesiated salt solution using an atomizer. Grade five dry nitrogen is used to provide the back pressure for the atomizer. From two to four coats are applied. The cathode is then placed in a vacuum oven, evacuated to less than 1 torr., baked at a sufficient temperature and duration to evaporate the de-ionized water (over 100 degrees centigrade for about an hour or more), and then vented to atmospheric pressure using grade five dry nitrogen. A single cycle of three coatings will improve cathode performance and reduce out-gassing. However, further cycles of three coatings can be repeated, with improvements on each cycle. A number of low work function cesiated salts can be used, including cesium iodide (CsI), cesium tellurate ($CsTeO_4$), and cesium bromide (CsBr).

The cathode can also be dipped tip first into this cesiated salt solution and the entire assembly, cathode and solution, baked to about 100 degrees centigrade or greater at atmospheric pressure such that the solution crystallizes around the tips of the cathode. Once the solution has crystallized, the cathode is placed in a vacuum oven and baked to remove any remaining water. The system is then vented to the atmosphere using dry nitrogen.

In addition, the cesiated salt can be deposited by dipping the carbon cathode into a crucible of molten cesiated salt. The cathode is placed so that the carbon tips of the carbon velvet material extend into the molten bath. The molten cesiated salt is then allowed to cool with the cesiated salt crystallizing at the cathode tips. Cesiated salt can also be deposited by chemical vapor deposition such that the cesiated salt crystals form near the tips. Each of these processes is more expensive and time consuming than using the DI water solution of cesiated salt, but each results in a more uniform coating of the cesiated salt. On the other hand, it is not necessary to bake out the cathode to remove excess water vapor with these methods.

FIG. 1 is a schematic of the laboratory setup, including a cross section of the present invention, used to test the field emission cold cathode characteristics. It consists of a vacuum vessel with a high voltage bushing, cathode mount, cathode and anode. The anode-cathode gap can be changed by moving the shaft upon which the anode is mounted. A sufficient negative voltage is applied to the cathode. An electric field as low as 0.9 kV/cm has been demonstrated to be sufficient to initiate electron flow. This is far less than the typical electric fields used in conventional vacuum tubes. Electrons are emitted from the cathode surface and accelerated through the anode-cathode gap and the electrons then impact the anode. The high voltage source may be a pulsed or continuous. The cathode can be employed in any general geometry from circular to spherical, cylindrical, or planar, or in any other complex shape. The anode-cathode gap can represent any interaction region or other region in which the electrons are used. The anode region can be any region or structure in which electrons are collected.

The turn-on field (the electric field level at which the electrons start to flow) of the cathode can be tailored in several ways. The length and density of the carbon fibers can be varied. A longer, narrower tip and a lower tuft density permit greater field enhancements at the fiber tips and hence a lower effective turn-on field. The turn-on field can also be reduced by changing the amount of cesiated salt in solution and by varying the number of coats applied to the surface. In some microwave tubes it is desirable to not have electrons flow until the voltage reaches its full value. This can be accomplished by varying the tuft density and/or the amount of cesiated salt applied, either by the number of coats or by the saturation level of cesiated salt in solution with DI water.

What is claimed is:

1. A field emission cold cathode comprising:

a cathode having a cathode surface;

high aspect ratio carbon fibers bonded to the cathode surface; and the carbon fibers being coated with a cesiated salt selected from the group consisting of cesium tellurate and cesium bromide.

2. A carbon velvet material field emission cold cathode comprising:

a carbon velvet material coated with a low work function cesiated salt;

a cathode base surface comprised of carbon; and pyrobonding the carbon velvet material to the cathode base surface.

3. The cold cathode of claim 2, wherein the carbon velvet material is comprised of high aspect ratio carbon fibers.

4. The cold cathode of claim 2, wherein the cesiated salt is selected from the group consisting of cesium tellurate and cesium bromide.

5. The cold cathode of claim 2, wherein the carbon velvet material is coated with the low work function cesiated salt by spraying a solution of the cesiated salt and de-ionized water onto the carbon velvet material, placing the cathode into a vacuum oven evacuated to less than 1 torr., and baking the cathode at over 100 degrees centigrade for a period sufficient to remove the de-ionized water.

6. The cold cathode of claim 3, wherein:

each of the carbon fibers is comprised of a shaft and a tip; and the cesiated salt is deposited solely on a plurality of the tips.

* * * * *